US007090880B1

(12) United States Patent
Droste et al.

(10) Patent No.: US 7,090,880 B1
(45) Date of Patent: Aug. 15, 2006

(54) BEVERAGE CONTAINER

(75) Inventors: Fred Savrij Droste, DG Warnsveld (NL); Maria Cornelia Hendrika Kamp-Stroeken, Al Ijsselmulden (NL)

(73) Assignee: Ball Packaging Europe GmbH, Ratingen (DE)

( * ) Notice: Subject to any disclaimer, the term of this patent is extended or adjusted under 35 U.S.C. 154(b) by 0 days.

(21) Appl. No.: 09/806,026

(22) PCT Filed: Sep. 24, 1999

(86) PCT No.: PCT/NL99/00597

§ 371 (c)(1),
(2), (4) Date: Sep. 13, 2001

(87) PCT Pub. No.: WO00/17065

PCT Pub. Date: Mar. 30, 2000

(30) Foreign Application Priority Data

Sep. 24, 1998 (NL) ..... 1010181

(51) Int. Cl.
*B65D 85/72* (2006.01)

(52) U.S. Cl. ..... 426/124; 426/115; 426/131; 426/132; 426/397; 426/401; 426/112; 206/222; 220/501; 220/553; 53/420; 53/432

(58) Field of Classification Search ..... 426/112, 426/115, 124, 131, 132, 397, 401; 206/222; 220/501, 553; 53/420, 432
See application file for complete search history.

(56) References Cited

U.S. PATENT DOCUMENTS 5,683,732 A 11/1997 Baxter et al. ..... 426/115

*Primary Examiner*—Milton Cano
*Assistant Examiner*—Sarah L Kuhns
(74) *Attorney, Agent, or Firm*—Foley & Lardner LLP

(57) ABSTRACT

The invention provides a container of substantially form-retaining material, for instance aluminum, steel or other metal, or PET (polyethylene terephthalate) or other plastic, for a liquid, which must be provided prior to consumption with a foaming head, such as chocolate milk, cappuccino, milkshake, which container comprises:

a circumferential wall;

a base which is connected along its whole periphery to this wall or is integrally formed therewith;

a cover which, after filling of the container with the liquid, is optionally arranged on the side remote from the base and which is connected to this wall along its whole periphery; and;

a cartridge present in the container and in the filled and closed situation of the container at least partially filled with a gas under pressure serving as foaming medium in the wall of which cartridge is situated at least one continuous hole for passage of gas.

23 Claims, 4 Drawing Sheets

BEVERAGE CONTAINER

A metal container for a beer is known which comprises:

a wall formed into a closed contour;

a base which is connected along its whole periphery to this wall;

optionally a cover which is arranged on the side remote from the base after filling of the container with beer and which is connected along its whole periphery to this wall; and a cartridge which is coupled to the base and extends from the base over some axial distance and which defines two passages, the first of which is situated in an end wall of the cartridge remote from the base and the second of which is situated in the region of the base;

which cartridge has the general shape of a beaker, which beaker is coupled with the edge zone of its mouth to the base of the container by means of coupling means.

Such a container is filled with beer by the beer supplier, whereafter a drop of liquid nitrogen is deposited on the surface, following which the container is then rapidly closed with the cover. The liquid nitrogen evaporates and an overpressure is created in the can. By turning over the can, thus such that the base is situated at the top, the gas under pressure enters the cartridge. After the can has been turned over again, the gas remains behind in the cartridge since the first passage is so narrow that due to the capillary action the beer cannot pass through the aperture. Due to the presence of equal pressure in the whole container the cartridge remains at least for the greater part filled with gas under pressure. Only after opening of the container, for instance by removing the cover or tearing loose a pull tab, is it possible for the gas to escape and it will do so via the first aperture. This is so narrow that a flow of small nitrogen bubbles will be displaced through the beer, thereby resulting in a stiff foam of very good quality.

The invention now relates to a mechanically stable, substantially form-stiff container for a consumable liquid, for instance a milkshake liquid or the like, i.e. a liquid to which a foaming character typical of milkshakes can be imparted by injecting gas.

In respect of this objective the invention provides a container of substantially form-retaining material, for instance aluminium, steel or other metal, or PET (polyethylene terephthalate) or other plastic, for a liquid which must be provided prior to consumption with a foaming head, such as chocolate milk, cappuccino, milkshake, which container comprises:

a circumferential wall;

a base which is connected along its whole periphery to this wall or is integrally formed therewith;

a cover which, after filling of the container with the liquid, is optionally arranged on the side remote from the base and which is connected to this wall along its whole periphery; and a cartridge present in the container and in the filled and closed situation of the container at least partially filled with a gas under pressure serving as foaming medium, in the wall of which cartridge is situated at least one continuous hole for passage of gas.

A specific embodiment has the special feature that gas is also situated in the liquid present in the container.

An embodiment wherein the gas contains carbon dioxide, or consists wholly thereof, has the advantage that the carbon dioxide can enhance a for instance somewhat fruity, sourish flavour of a milkshake. Because of its slightly sourish character, carbon dioxide is somewhat less suitable for other flavours, for instance chocolate.

Alternatively, it is possible to envisage an embodiment wherein the gas contains nitrogen gas. The drawback of nitrogen gas is that it is not very readily soluble in water or in aqueous solution or mixture. In the case where the gas must also be present in the liquid, nitrogen may for this reason be a less suitable choice. In the case where gas is taken up in the cartridge, nitrogen is very suitable. As described above, the nitrogen gas can be introduced into the cartridge during a per se very simple and ingenious process.

A specific embodiment has the special feature that the gas contains nitrous oxide. Nitrous oxide has the advantage of a great solubility in aqueous substances and gives a good, rather sweetish taste which is also highly compatible with for instance chocolate-like flavours. The drawback of nitrous oxide can be that it is slightly more expensive than carbon dioxide. Attention is drawn to the fact that the use of nitrous oxide in milkshake liquid containers is known from WO-A-96/33618. According to the invention however, use is made of a cartridge which after opening of the container can emit the gas present therein via an opening in the form of gas bubbles through the liquid, thereby creating a stiff foam. The art according to said international patent application does not provide such a controlled foam formation.

Filling of the containers can for instance take place at a temperature in the order of magnitude of 10° C. The liquid can then if desired be saturated with the gas in question, whereafter injection of the same gas or gas of another type takes place. The container is then closed and sterilization takes place.

The addition of said gases can take place in gaseous form, but also in solid form ($CO_2$, $N_2O$) or as liquid ($N_2$, $N_2O$) by cooling the gas in question to a suitably low temperature. Carbon dioxide can be created by adding a (weak) acid to the content of the container. A quantity of (bi)carbonate corresponding to the quantity of acid is added a short time before closure of the container.

An alternative embodiment has the special feature that a first gas is dissolved in the liquid and a second gas substantially insoluble in the liquid is situated in the cartridge. The relatively inexpensive carbon dioxide for instance, which can further add a specific, somewhat sourish flavour to the drink, can be dissolved in the liquid. As propellant for foam formation can be used nitrogen which is substantially insoluble in the liquid. Another possible combination consists of the soluble nitrous oxide and the insoluble nitrogen. The combination of the nitrous oxide and nitrogen provides the liquid with a stiff foaming head that is stable for 15 minutes at refrigerator temperatures (4 to 6 degrees Celsius).

With an appropriate choice of the gas or the combination of gases, any suitable combination of the relevant properties can be obtained within relatively close tolerances. These relevant properties include the product-specific nature of the foam, for instance a stiff foam with small bubbles or a somewhat less stiff foam, a specific flavour, a product-specific aroma, this inasfar as is possible with a view to an economically interesting solution. Attention is drawn in this respect to the fact that the price of the different gases varies widely, while different methods must moreover also be applied for introducing the different gases into the container.

A specific embodiment has the special feature that the gas contains an aromatic component. Such an aromatic component is chosen in respect of a desired character of the milkshake for pouring. It should be appreciated that due to the more or less viscous nature of the foamy milkshake liquid in the opened state of the container or in the poured state the emission of the gas will take place relatively slowly, whereby the aromatic component can remain active for a longer period. The same activity of the propellant gas acting as foaming agent continues during this time, so that a stiff foam remains in place for a longer time.

The known beer container has coupling means which comprise a gluing surface, whereby the cartridge is adhered with a surface to the base of the container.

The use of glue has a number of drawbacks. For legal reasons only very few glue types can be employed for foodstuffs. There is the further danger that a glue will affect the flavour of milkshake liquids. In respect of production technique, a drawback of using glue is that it requires a specific operation and that glue needs time to harden.

In the container according to the invention the cartridge can be accommodated in the container in any desired and suitable manner. The cartridge can for instance be accommodated in the milkshake liquid in floating or substantially freely-suspended manner. Such an embodiment can have the advantage that possible inhomogeneities in the composition of the milkshake, consisting of components of different density, can be removed by vigorous shaking of the container. A drawback of a loose cartridge can be that the control of the gas filling is less good due to the nature of the filling process, while moreover the loose cartridge will itself possibly be damaged, certainly during shaking and also during transport, or will damage the inner surface of the container, which will possibly cause some decrease in the quality of the milkshake liquid.

With a view to the above, the invention further provides a container which has the special feature that the coupling means are exclusively mechanical and are embodied such that between the edge zone of the cartridge and the base of the container there remains some space, which space defines the second passage. It should be understood that in this manner the cartridge is fixed more or less loosely to the base.

A particular embodiment has the special feature that the base has an axially displaced part having an at least partly undercut peripheral zone; and the edge zone takes an at least partly undercut form;

which peripheral zone and which edge zone mutually engage while retaining a clearance such that the cartridge is coupled to the base.

A very simple embodiment has the special feature that the coupling means comprise snap means. In this embodiment the cartridge can be snap-coupled to the base by a simple snapping operation and by overcoming a snapping force determined by the dimensioning parameters.

Another embodiment, which implies the advantage of a slightly greater control but the drawback of an additional process step, has the feature that at least one of the peripheral zone and the edge zone is compressed at least partially in axial direction while enclosing the other.

A preferred embodiment has the special feature that the first passage has a form narrowing toward the outside relative to the cartridge. A foam formation of very high quality can hereby be realized.

This latter embodiment preferably has the special feature that the first passage has a length of (3±1) mm, an entry diameter of (0.9±0.2) mm and an exit diameter of (0.25±0.05) mm.

Attention is drawn to the fact that the effective passageway of the second passage is not very critical. In general it can even be stated that a snap connection is not at all gas-tight, while the described embodiment, wherein the peripheral zone and/or the edge zone is compressed in axial direction, also ensures an adequate passage of gas.

It is known to use an insert piece which is manufactured for instance from plastic and provided with a passage and which is for instance placed in snapping co-action with an aperture of the cartridge. Such an insert piece can serve to define the first and the second passage. According to the invention the necessity of arranging a defined second passage becomes wholly superfluous. This also implies that it is unnecessary to arrange an insert piece of the described type. Use can be made, if desired, of such a known insert piece for the second passage. The invention does not relate per se thereto.

However, in order here also to be able to wholly dispense with extra components, according to the invention a particular embodiment can have the special feature that the first passage is formed by perforation.

The described embodiment, wherein the first passage has a form narrowing toward the outside, can advantageously display the feature that the first passage is made by perforating with a bradawl having a conical tip.

The embodiment in which the first passage complies with the above stated dimensioning specification can be made in the manner described with a bradawl with conical tip. This embodiment then has the special feature that the tip of the bradawl has a shape corresponding with the shape of the passage and is displaced relative to the end wall of the cartridge over an axial distance corresponding with the desired shape of the passage.

In order to enable easy transport of the prefabricated cartridges in mutually stacked layers, the embodiment is recommended in which the exit of the first passage does not protrude axially beyond the peripheral edge of the end wall.

Particularly in an embodiment in which the first passage extends over a certain axial length, a preferred embodiment has the special feature that the end wall has a recess.

The container according to the invention preferably has the feature that the cartridge consists substantially of the same material as the container. This embodiment has the advantage of being easily recyclable because it consists substantially of one material, with the exception of course of possible lacquer layers, printing and the like. In addition, galvanic effects are avoided, whereby metal ions could enter into solution and could affect the flavour of the milkshake liquid.

Also in order to prevent this latter phenomenon a variant can display the feature that at least a part of the inner surface of the container and the surfaces of the cartridge are provided with a coating, for instance a lacquer coat. This lacquer coat can be applied in advance. Use can also be made of electro-coating.

The invention will now be elucidated with reference to the annexed drawings, wherein.

Figure 1:
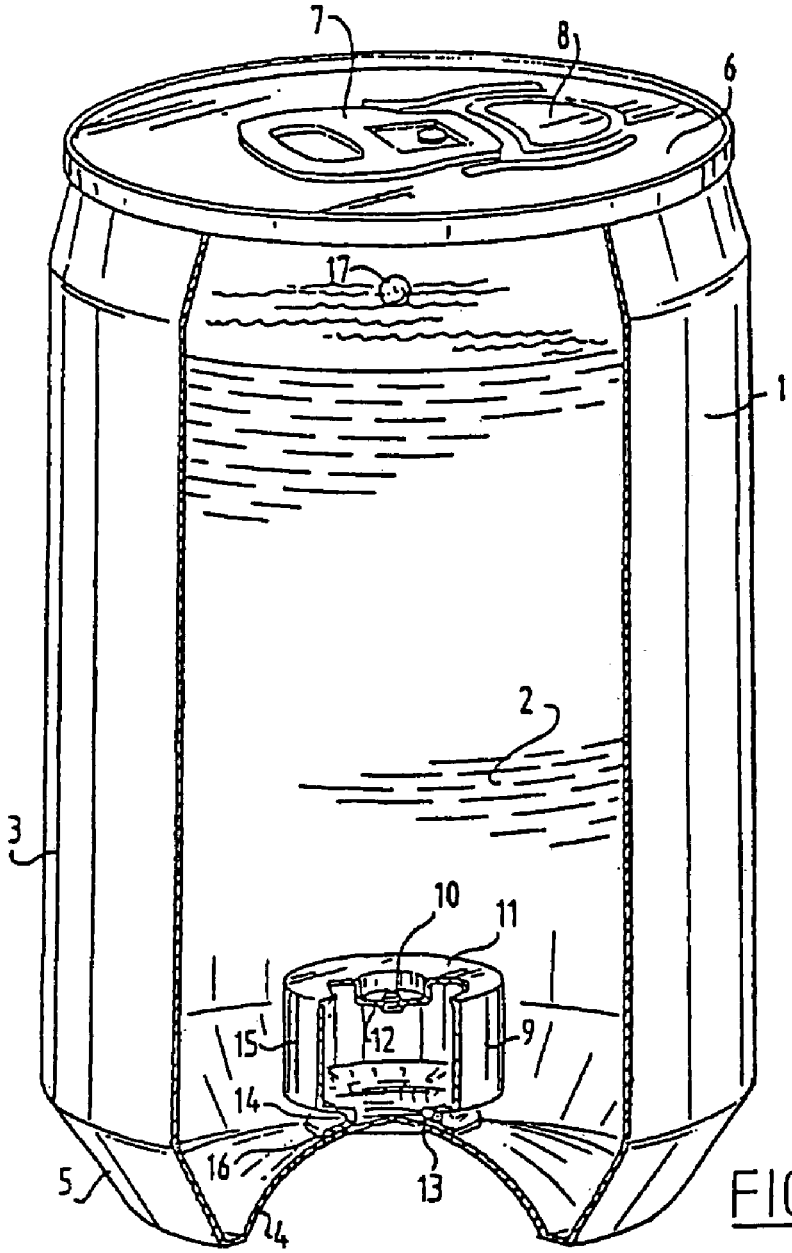
FIG.1 PRIOR ART
FIG. 1 shows a partly broken away perspective view of a beer container of the prior art manufactured by wall-ironing.

FIG. 1 shows an aluminium container 1 for milkshake liquid 2. The container comprises an at least partly cylindrical wall 3, a concave base 4 which is formed integrally with wall 3 and is connected thereto via a conical part 5. The container further comprises a cover 6 which, after filling of container 1 with milkshake liquid 2, is connected to wall 3 over the whole periphery on the side remote from base 4. The cover comprises an opening 8 for opening by means of a pull tab 7. An aluminium cartridge 9 is fixed to the base 4 by means of a glue layer (not shown). This cartridge 9 is provided with two bushes with narrow passage extending through the cartridge wall. The first bush 10 is arranged in the end wall 11 remote from the base 4 in a recessed part 12 of this end wall 11. A second bush 13 which is identical to the first bush 10 is situated on the underside of cartridge 9 in a constricted part 14 forming the transition between peripheral wall 15 and the lower edge 16 which is glued fixedly to the base 4.

In the situation shown in FIG. 1 the can 1 has been closed shortly before by the cover 6. Prior to this closure a drop 17 of liquid nitrogen was introduced, immediately after which the can was closed. As described above, a part of the available nitrogen, which places the can under pressure by evaporation, is taken up into the gas cartridge 9.

Figure 2:
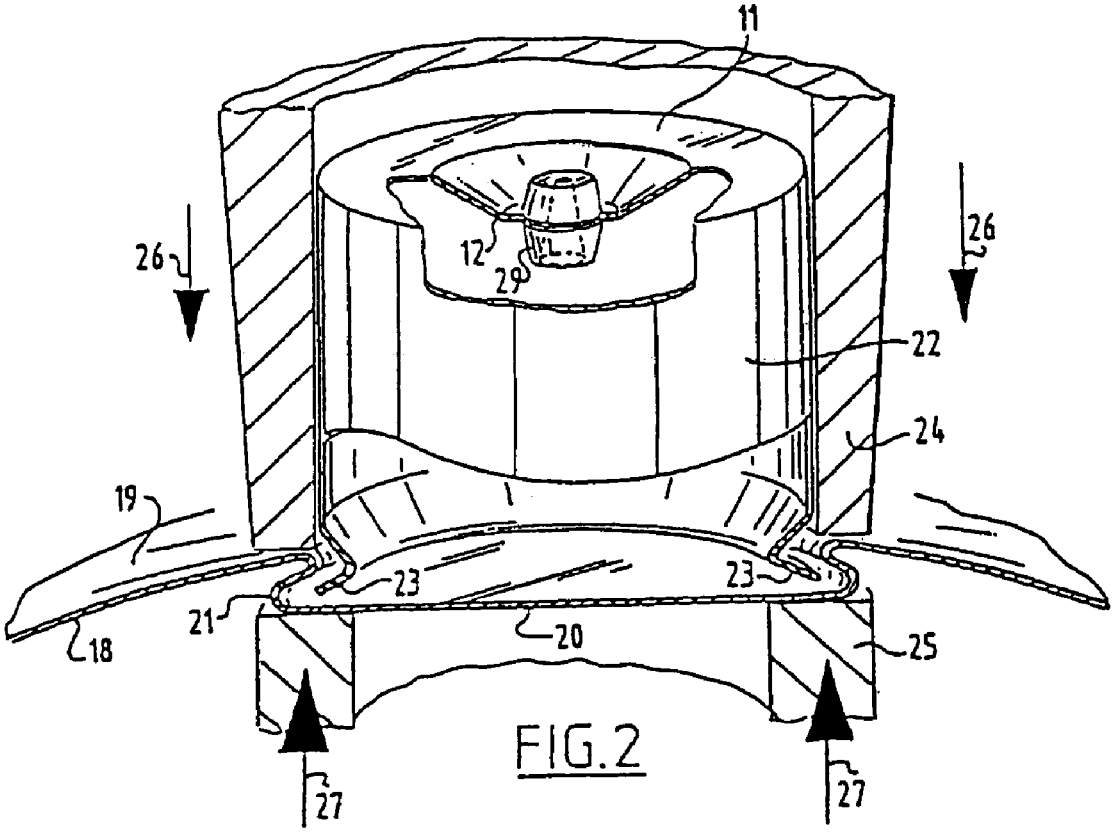
FIG. 2 shows a sectional perspective view of a detail of a container according to the invention in a production stage.

FIG. 2 shows a preliminary stage in the manufacture of a first embodiment of a container according to the invention.

The base 18 of a preformed container 19 has an axially displaced central part 20 which is joined via an undercut edge 21 to the rest of the base 18.

A preformed gas cartridge 22 has a constricted lower edge 23. In the situation shown in FIG. 2 in which the lower edge 23 is placed on the central part 20, an axial pressure force is exerted on the undercut edge 21 by co-acting annular tools 24 and 25 as according to arrows 26 and 27 respectively. The edge 21 is hereby compressed into the shape shown in FIG. 3, wherein the free end portion 28 of the constricted lower edge 23 is enclosed by the now compressed undercut bottom edge 21.

Figure 4:
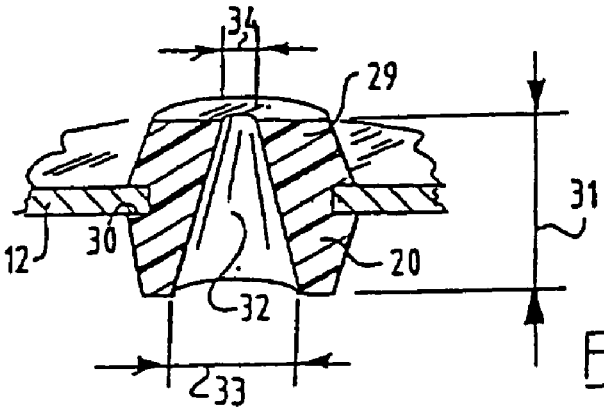
FIG. 4 shows the detail IV as according to FIG. 2.

FIG. 4 shows a nylon bush 29 which is received as according to FIG. 2 in the recessed part 12 of end wall 11 of cartridge 22. The plastic bush 29 has a peripheral groove 30 into which fit the edges of a hole arranged in the recessed part 12. The length 31 of the passage 32 amounts to 3 mm, while the entry diameter 33 amounts to 0.9 mm and the exit diameter 34 to 0.25 mm.

Figure 5:
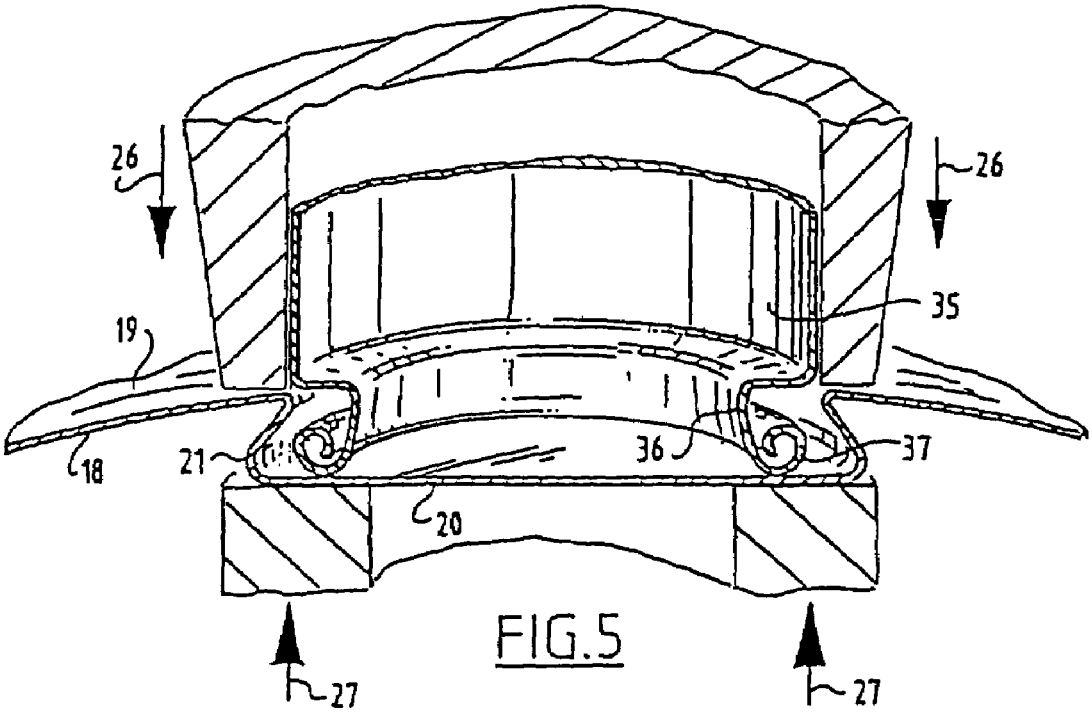
FIG. 5 is a view corresponding with FIG. 2 of a second embodiment in the production stage.

FIG. 5 shows a second embodiment. A preformed cartridge 35 is provided with a constricted lower edge 36, the free end portion of which has a beaded edge 37. The tools 24 and 25 can be the same as in FIG. 2.

Figure 6:
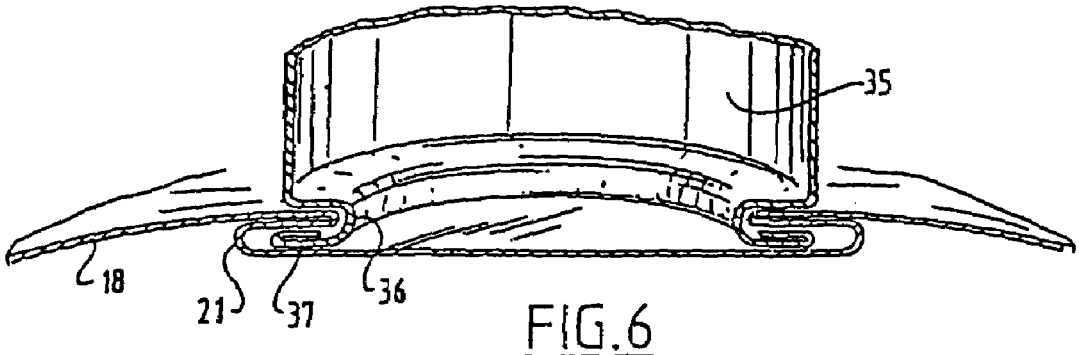
FIG. 6 is a view corresponding with FIG. 3 of the final stage of the second embodiment.

FIG. 6 shows the final stage in which both the undercut edge 21 of the can base 18 and the beaded edge 37 are axially compressed. The compressed beaded edge 37 is enclosed by the compressed edge 21 whereby the cartridge 35 is fixed to base 18.

Attention is drawn to the fact that due to the operations shown in FIGS. 2 and 5 the coupling between the co-acting edges is not clearance-free. It is precisely this remaining clearance or space between the co-acting surfaces which forms the basis of this aspect of the invention, in that this clearance renders superfluous the use of the second bush 13 according to FIG. 1 or other passage manufactured during a separate operation in the end of the gas cartridge directed toward the base 18.

Figure 3:
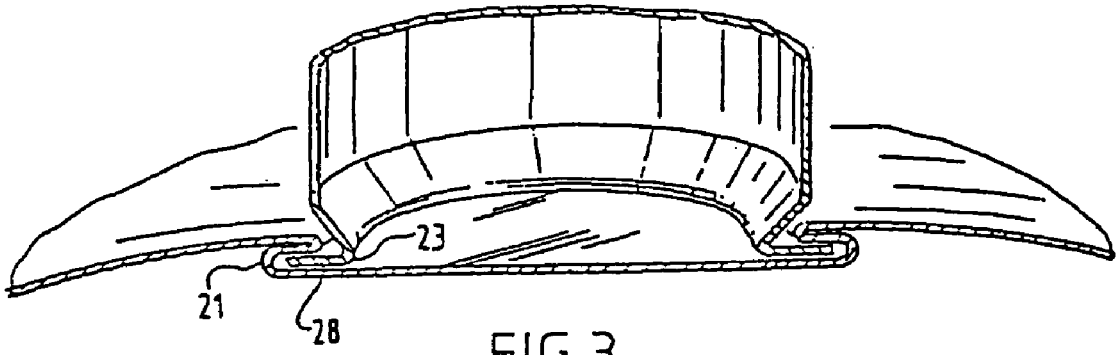
FIG. 3 shows a view corresponding with FIG. 2 of the final stage.
Figure 7:
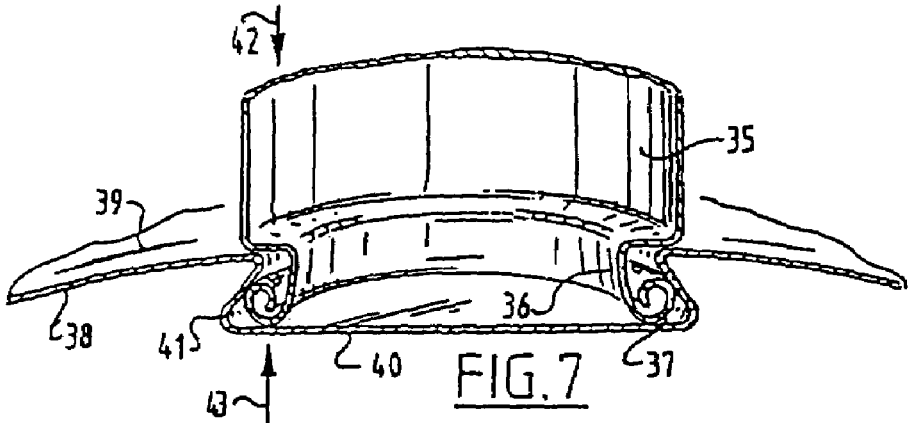
FIG. 7 is a view corresponding with FIGS. 3 and 6 of a third embodiment.

FIG. 7 shows a variant. In this embodiment use is made of the same cartridge 35 as in FIG. 5. The base 38 of a container 39 has a central part 40 in recessed position which connects via an undercut edge 41 to the rest of the base 38. The dimensioning of the undercut edge 41 is such that the beaded edge 37 can only pass over the undercut edge 41 by exerting a certain axial force (indicated with arrows 42, 43) such that the beaded edge 37 is accommodated in the undercut portion of this edge 41. The final situation obtained is shown in FIG. 7. Even more than in the embodiment according to FIGS. 3 and 6 is it the case that in this embodiment the coupling between edge 41 and beaded edge 37 is not gas-tight and enables passage of nitrogen to the interior of the cartridge 35

FIGS. 8, 9, 10 and 11 show a production method for a gas cartridge 44 (see FIG. 11) which functionally corresponds with the gas cartridge 22 according to FIG. 2. The difference from gas cartridge 22 lies in the manufacture of the passage 45, the form of which can correspond virtually exactly with the form of the passage 32 according to FIG. 4.

Figure 8:
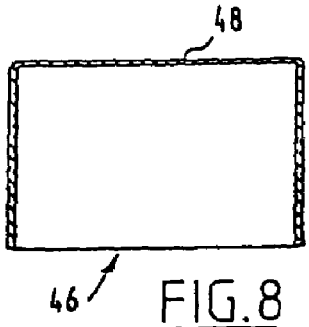
FIGS. 8, 9, 10 and 11 show in cross section four successive production stages of a gas cartridge.

As starting point for the manufacture of cartridge 44 use is made of an aluminium beaker 46 (see FIG. 8)

Figure 9:
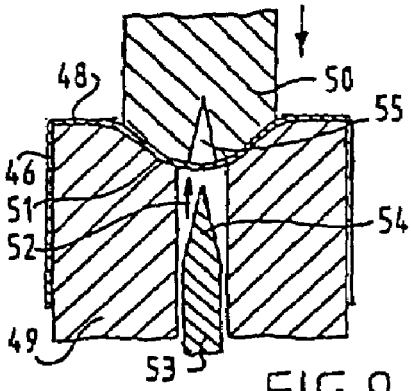

As shown in FIG. 9, the beaker 46 is placed on a supporting tool 49 which serves as anvil and can co-act with a correspondingly formed stamping tool 50 to form a recessed central part 51 in the end wall 48. While the stamp 50 is still pressing the recess 51 against the anvil 49 a perforating operation takes place by axially displacing according to arrow 52 a bradawl 53 with a sharp tip 54, the top angle of which corresponds with the angle of the passage 32 as according to FIG. 4. The shape of a conical cavity 55 in stamping tool 50 corresponds with the shape of the tip 54 and with the dimensioning of passage 32 according to FIG. 4.

Figure 10:
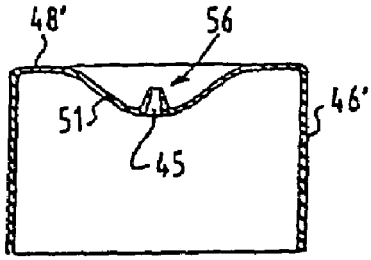
Figure 11:
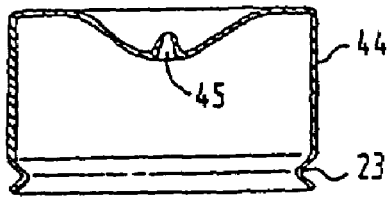

After retracting the stamping tool 50 the thus formed cartridge 46' can be removed from the supporting tool 49. The obtained form is shown in FIG. 10. It can be seen clearly that the passage 45 is roughly in the middle of the central recessed part 51. It is noted that the exit 56 of passage 45 is situated below the principal plane of end wall 48'. The cartridges 44 can hereby easily be stacked on one another for transport purposes.

In a final operation the constricted lower edge 23 is arranged.

Figure 12:
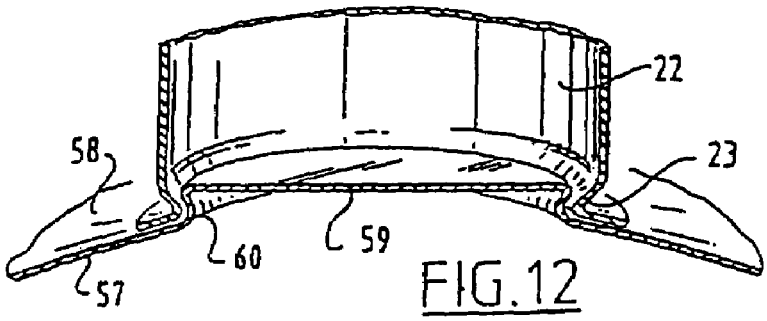
FIG. 12 is a view corresponding with FIG. 7 of a variant.

Finally, FIG. 12 shows a base 57 of a container 58 having a central part 59 displaced axially inward. It is pointed out in this respect that the recesses 20 and 40 were displaced in the above described embodiments. The central part 59 connects onto the rest of the base 57 via an undercut edge 60. The dimensioning of the constricted lower edge 23 of cartridge 22 is such that it can be placed in snapping manner over the undercut edge 60. This embodiment corresponds in this sense with the variant shown in FIG. 7.

Attention is drawn to the fact that further variants are also possible within the scope of the invention. Snap connections and clamp connections can for instance be used, sharp end edges and beaded edges can be applied, bulges can extend outward and inward, beaded edges can be situated on the outside and inside and sharp edges can also be situated both on the inside and outside. The invention is further not limited to specific materials. Particularly aluminium and steel cans are possible. These cans can be provided in any production stage, and also in advance, with coatings, for instance lacquer coats or layers applied by galvanic means.

The invention claimed is:

1. Container of substantially form-retaining material, which container is filled with a liquid, which must be provided prior to consumption with a foaming head, which liquid comprises dissolved therein a first gas, which container comprises:

a circumferential wall;

a base which is connected along its whole periphery to this wall or is integrally formed therewith;

a cover which, after filling of the container with the liquid, is connected to the circumferential wall along its whole periphery; and a cartridge present in the container and at least partially filled with a second gas which under pressure serves as foaming medium, in the wall of which cartridge is situated at least one continuous hole for passage of gas; and in the free container space a second gas creating over pressure in the closed container;

wherein the first gas is nitrous oxide, and the second gas is nitrogen, and wherein the nitrous oxide and nitrogen, in combination, provide the liquid with a stiff foaming head that is stable for 15 minutes at refrigerator temperatures.

2. Container as claimed in claim 1, wherein the gas contains an aromatic component.

3. Container as claimed in claim 1, comprising:

a cartridge which is coupled to the base and extends from the base over some axial distance and which defines two passages, the first of which is situated in an end wall of the cartridge remote from the base and the second of which is situated in the region of the base;

which cartridge has the general shape of a beaker which beaker is coupled with an edge zone of its mouth to the base of the container by means of coupling means;

wherein the coupling means are exclusively mechanical and are embodied such that between the edge zone of the cartridge and the base of the container there remains some space, which space defines the second passage.

4. Container as claimed in claim 3, wherein the base has an axially displaced part with at least partly undercut peripheral zone; and the edge zone of the cartridge takes an at least partly undercut form;

which peripheral zone and which edge zone mutually engage while retaining a clearance such that the cartridge is coupled to the base.

5. Container as claimed in claim 4, wherein the coupling means comprise snap means.

6. Container as claimed in claim 4, wherein at least one of the peripheral zone and the edge zone is compressed at least partially in axial direction while enclosing the other.

7. Container as claimed in claim 3, wherein the first passage has a form narrowing toward an area outside of the cartridge.

8. Container as claimed in claim 7, wherein the first passage has length of (3±1) mm, an entry diameter of (0.9±0.2) mm and an exit diameter of (0.25±0.05) mm.

9. Container as claimed in claim 3, wherein the first passage is formed by perforation.

10. Container as claimed in claim 7, wherein the first passage is made by perforating with a bradawl having a conical tip.

11. Container as claimed in claim 10, wherein the tip of the bradawl has a shape corresponding with the shape of the passage and is displaced relative to the end wall of the cartridge over an axial distance corresponding with the desired shape of the passage.

12. Container as claimed in claim 3, wherein the exit of the first passage does not protrude axially beyond the peripheral edge of the end wall.

13. Container as claimed in claim 12, wherein the end wall has a recess.

14. Container as claimed in claim 1, wherein the cartridge consists substantially of the same material as the container.

15. Container as claimed in claim 1, wherein at least a part of the inner surface of the container and the surfaces of the cartridge are provided with a coating.

16. Method for preparing a beverage container containing a consumable liquid so that the liquid will provide a foaming head upon opening the container for consumption, comprising the following steps:

providing a container comprising a circumferential wall, a base which is connected along its whole periphery to this wall or is integrally formed therewith, and a cover which, after filling of the container with the liquid, is connected to the circumferential wall along its whole periphery;

accommodating a cartridge in the container, the cartridge being at least partially filled with nitrogen under pressure serving as foaming medium;

filling consumable liquid into the container, dissolving nitrous oxide in the liquid, and closing the container, and wherein the nitrous oxide and nitrogen, in combination, provide the liquid with a stiff foaming head that is stable for 15 minutes at refrigerator temperatures.

17. Method according to claim 16, wherein nitrous oxide is dissolved in the liquid after filling the liquid into the container.

18. Method according to claim 16, wherein the liquid is selected from chocolate milks, cappuccinos, and milkshakes.

19. Container as claimed in claim 1, wherein the said form-retaining materials is selected from the group consisting of aluminum, steel, other metal, polyethylene terephthalate, and other plastic.

20. Container as claimed in claim 1, wherein the liquid is selected from chocolate milk, cappuccino, and milkshake.

21. Container as claimed in claim 15, wherein the coating is a lacquer coat.

22. Container as claimed in claim 1, wherein the liquid is non-alcoholic.

23. Method as claimed in claim 16, wherein the liquid is non-alcoholic.

* * * * *